United States Patent [19]

Gelain et al.

[11] Patent Number: 4,851,261

[45] Date of Patent: Jul. 25, 1989

[54] POWDER COATING BOOTH

[75] Inventors: Silvano Gelain; Bernhard Dinkel, both of St.Gallen, Switzerland

[73] Assignee: Ransburg-Gema AG, Switzerland

[21] Appl. No.: 178,522

[22] Filed: Apr. 7, 1988

[30] Foreign Application Priority Data

Apr. 11, 1987 [DE] Fed. Rep. of Germany ..... 3712437

[51] Int. Cl.[4] ..... B05D 1/12; B05B 15/12

[52] U.S. Cl. ..... 427/195; 427/424; 118/326; 98/115.2; 55/294; 55/493; 55/484; 55/DIG. 46

[58] Field of Search ..... 55/294, 493, 484, DIG. 46; 118/326; 98/115.2; 427/195, 421

[56] References Cited

U.S. PATENT DOCUMENTS

| | | | |
|---|---|---|---|
| 2,564,845 | 8/1951 | Holt | 55/493 |
| 3,810,350 | 5/1974 | Scholl | 55/493 X |
| 2,594,957 | 4/1952 | Martens | 55/294 |
| 3,811,371 | 5/1974 | Hardy | 118/326 X |
| 3,815,342 | 6/1974 | Watts | 55/493 |
| 4,509,961 | 4/1985 | Jones | 55/294 |

FOREIGN PATENT DOCUMENTS

| | | |
|---|---|---|
| 0021209A1 | 1/1981 | European Pat. Off. . |
| 448489 | 8/1927 | Fed. Rep. of Germany . |
| 970777 | 10/1958 | Fed. Rep. of Germany . |
| 2449065A1 | 4/1976 | Fed. Rep. of Germany . |
| 2947755A1 | 6/1980 | Fed. Rep. of Germany . |
| 8314662.8U1 | 7/1986 | Fed. Rep. of Germany . |
| WO86/03994 | 7/1986 | PCT Int'l Appl. . |

*Primary Examiner*—Shrive Beck

*Attorney, Agent, or Firm*—Ostrolenk, Faber, Gerb & Soffen

[57] ABSTRACT

A generally rectangularly shaped powder coating booth of a powder spraying apparatus is fomed of two main sections, each of which is constituted of wall and roof elements which are swingably interconnected to one another. The walls and roof of each half of the booth may be straightened out to form a flat, continuous and rectangularly shaped surface from which residues of powder may be removed easily and rapidly. Thus when the two halves of the booth are flattened out the booth is transformed into two parallel and spaced surfaces which can be cleaned by being vacuumed by a respective suction nozzle that is disposed to travel over and vacuum the surfaces automatically.

34 Claims, 3 Drawing Sheets

FIG. 1
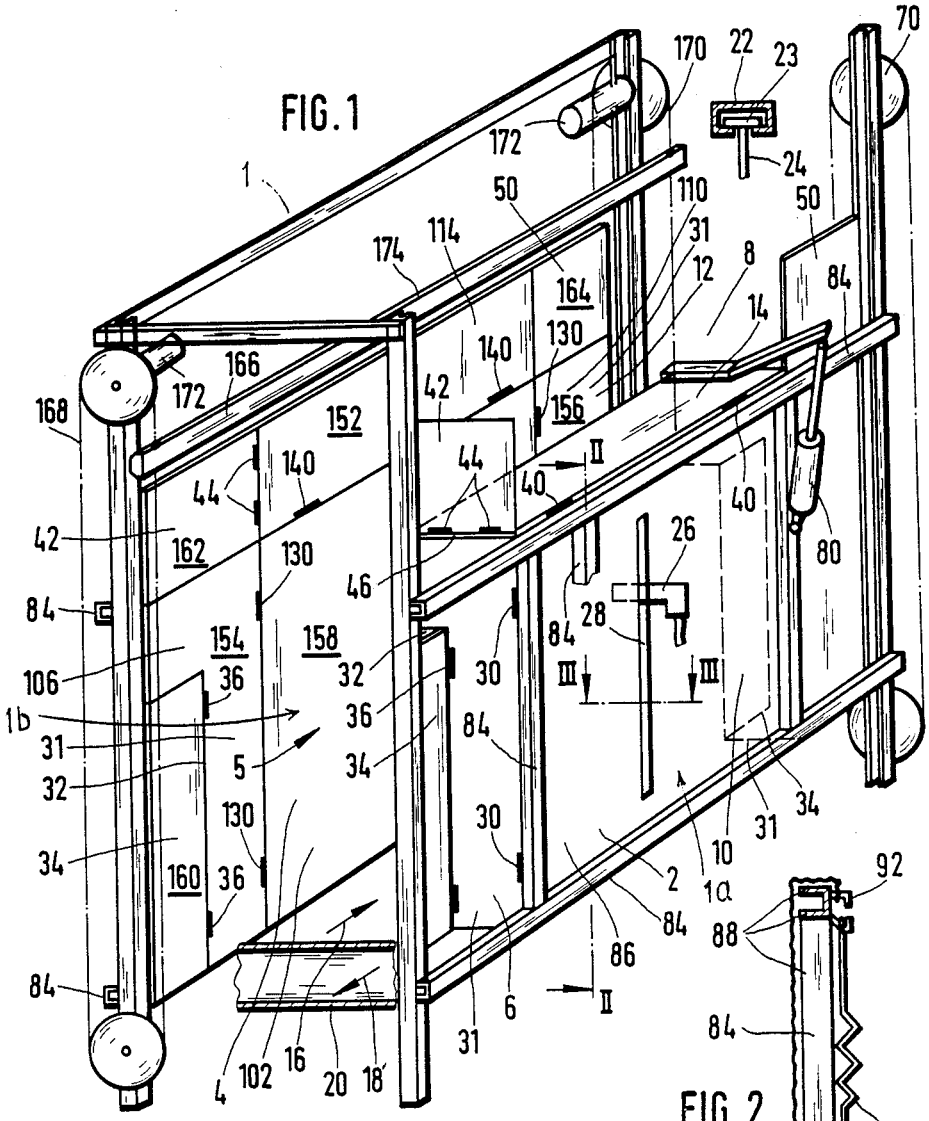
FIG. 2
FIG. 3
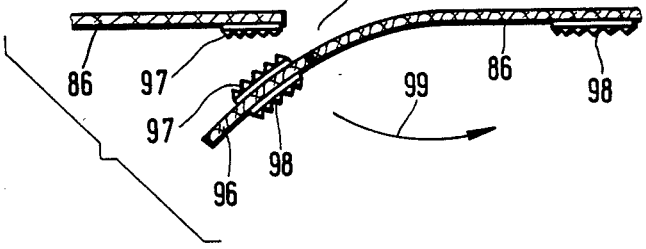

POWDER COATING BOOTH

BACKGROUND OF THE INVENTION

The present invention relates generally to a powder coating booth for coating articles with powder therein and, more particularly, relates to a novel, generally rectangular, powder coating booth which is formed by a plurality of wall elements that can be straightened out to form two flat, spaced, and parallel, walls so that residues of powder can be easily removed from the inner surfaces of the wall elements.

A powder coating booth for coating articles with powder therein is sometimes formed of several wall elements including a left, a right, a front, and a rear wall element and, in addition, a roof. The base of the booth is typically constituted of a movable belt and all the walls of the booth are permeable to air. Articles to be coated are transported in and out of the booth to be sprayed with a powder coating.

In a production environment, it is necessary, at times, to switch from one powder type or color to another. For color integrity and consistency, each powder change-over requires extremely careful and thorough cleaning of the inner surfaces of the walls of the booth of all traces of the previously used powder. The cleaning step disrupts the powder coating process. This is extremely disadvantageous and costly, particularly in mass production environments.

Not surprisingly, persons skilled in the art have been searching for years for the optimal solution that will shorten the switch-over period without adding complexity and cost and a solution that will not compromise the integrity of the cleaning process. The task has not been simple because powder coating quality considerations impose stringent specifications and limitations on the shape and construction of the coating booth. These specifications limit the permissible air current and air quantity levels in the coating booth. The climate in the booth room and the size of the entrance and exit opening through which articles pass into and out of the booth are also subject to stringent requirements. The energy required for maintaining the quality of the air in the booth must also be considered.

The prior art has proposed various solutions for reducing the cleaning time of the booth including a solution that is based on fusing the leftover traces of powder into the walls and roof of the booth, as taught by Federal Republic of Germany Pat. No. 30 12 878.

Another prior art idea is to form the walls and roof of the booth from revolving belts that are operated and cleaned in accordance with the teachings of Federal Republic of Germany Pat. No. 29 26 040.

Swiss Pat. No. 560 558 teaches to form the booth from porous wall and roof parts and to blow air inwardly from outside the booth to prevent accumulation of powder on the inner surfaces of the booth's walls and roof.

A different concept involving providing protective sheetings which are suspended in the booth to protect its inner surfaces is described in Federal Republic of Germany Utility Model No. 78 22 478.

Another prior art concept is based on forming the walls and roof of the booth from filter cloth which can be freed of traces of powder through the blowing of outside air into the interior of the booth room.

Another approach, described in Federal Republic of Germany Offenlegenschrift OS No. 22 48 367, involves creating an electric field on the plastic walls of the booth for repelling the powder away from the walls.

Finally, German Offenlegenschrift OS No. 30 15 929 proposes to form the walls and roof of the booth of easily removable individual panels which are dismantled for cleaning and then reassembled by hand at the conclusion of each cleaning cycle.

However, all of the foregoing solutions are either too complex or otherwise unacceptable because the attained surface cleanliness is inadequate or because the cleaning duration is too long.

SUMMARY OF THE INVENTION

Accordingly, the general object of the present invention is to provide an improved powder coating booth that is mechanically simple and easier and faster to operate without sacrificing the cleanliness standards.

The foregoing and other objects of the invention are realized by forming the coating booth from two, longitudinally separated, main sections. Each of the sections is constituted of a plurality of hingedly interconnected wall and roof elements which are normally oriented in a first configuration relative to one another to form one half of a spraying booth. In their first configuration, the two sections cooperate to define the entirety of the booth.

However, the wall and roof elements of each section can be manipulated to assume a second configuration in which the elements of the section are flattened or straightened out into a continuous, rectangularly shaped, flat wall. When both halves of the booth are flattened to assume the second configuration, the original aggregation of wall and roof parts which forms the booth is transformed into two spaced, parallel, flat walls. Those surfaces of the wall and roof parts which normally face the interior of the booth are disposed on one side in each of the resulting continuous flat walls so that the interior surfaces may be vacuumed in one sweeping motion of a vacuuming device.

Note that the second flattened configuration of the wall and roof elements is selected only during the cleaning process. Usually, the roof and the front and rear wall portions of each half of the booth are swung inwardly toward one another at an angle of 90° to form together a generally rectangularly shaped powder coating enclosure.

That each half of the booth is flattened to form a "continuous" wall means that the flattened individual inner surfaces of the walls closely adjoin one another in a manner that avoids creating large gaps in the flat wall which may interfere with the vacuuming process.

The vacuuming process of each of the flat walls is carried out by a respective vacuuming arrangement which includes a vacuuming head and an accompanying moving mechanism that moves the vacuuming head over its respective wall to vacuum all traces of powder from the interior surfaces of the wall. The rectangular shape and "continuity" of the flattened walls assures that the vacuuming head will not travel over gaps that will interfere with the vacuuming process.

Other features and advantages of the present invention will become apparent from the following description of the invention which refers to the accompanying drawings.

BRIEF DESCRIPTION OF THE DRAWINGS

FIG. 1 is a diagrammatic perspective of a powder coating booth according to the present invention.

FIG. 2 is a partial cross-section along the plane defined by line II—II of FIG. 1.

FIG. 3 is a partial cross-section through the plane defined by line III—III of FIG. 1.

DETAILED DESCRIPTION OF PREFERRED EMBODIMENTS

Figure 4:
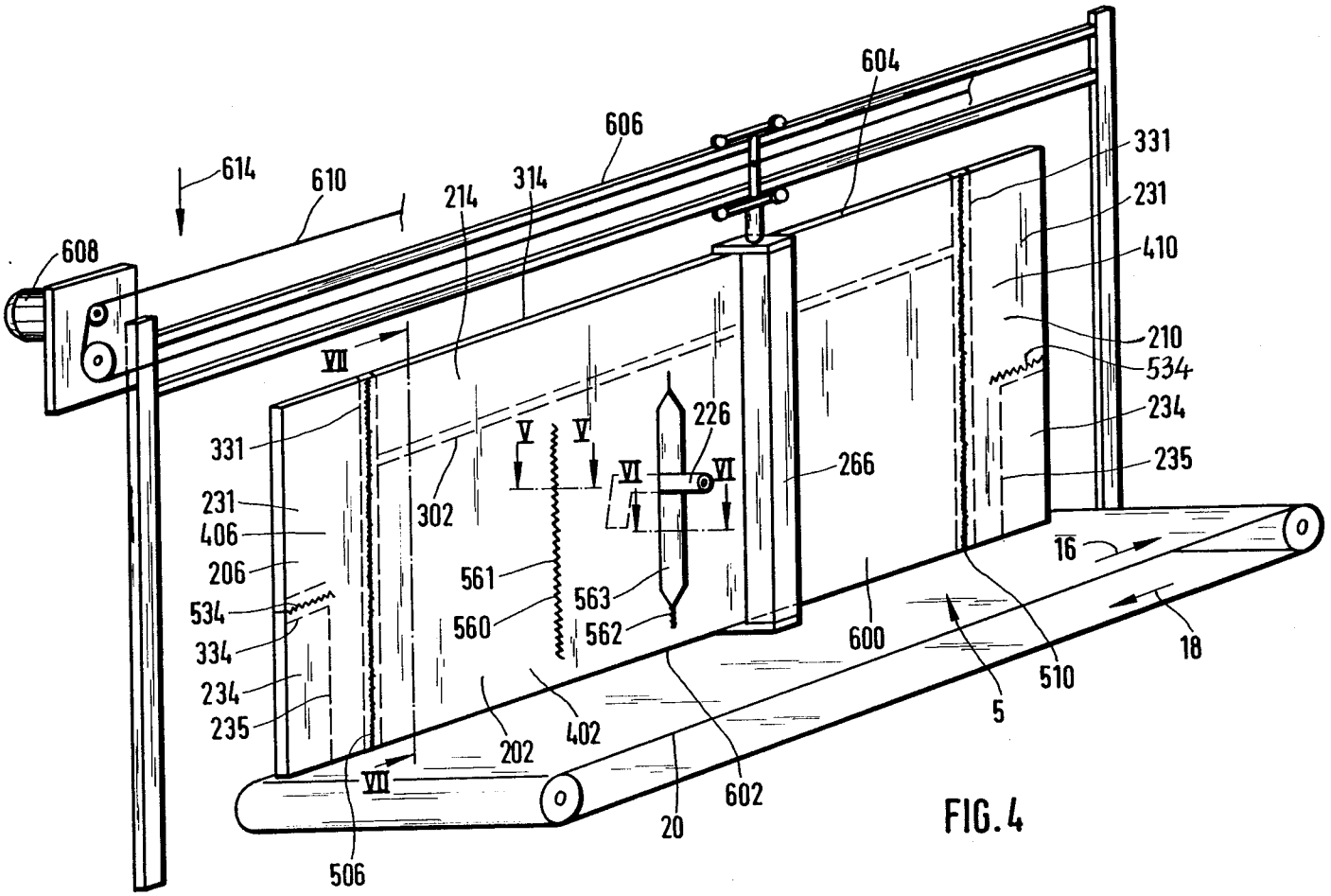
FIG. 4 is a perspective of the left-hand side and a portion of the bottom of another powder coating booth embodiment according to the present invention.
Figure 5:
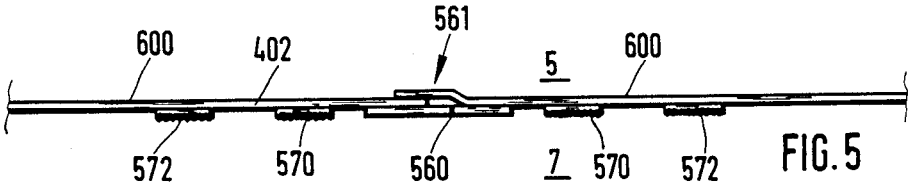
FIG. 5 is a partial cross-section through the plane defined by line V—V in FIG. 4.

Referring to FIGS. 1-3, a powder coating apparatus 1, according to the present invention, has a powder coating booth 5 which is constructed of two halves, including a right half 1*a* and a left half 1*b*. Each of the halves 1*a* and 1*b* is formed of a plurality of wall and roof elements which can be selectively straightened out into a flat surface for cleaning purposes or configured into half of the enclosure which forms the booth 5. In FIG. 1, booth half 1*a* is depicted in a first configuration forming one half of the booth 5 while booth half 1*b* is in a second flattened out configuration. Note that the left and right portions in FIG. 1 include similar elements. Accordingly, reference numbers of similar parts differ only in that 100 has been added to the reference numbers on the left of the Figure which shows booth half 1*b*.

Booth 5 is formed of: a right longitudinal wall 2 and a left longitudinal wall 102; a right front end wall 6 and a left front end wall 106 (at which there is formed an entrance opening 4 into the booth a right rear end wall 10 and a left rear end wall 110 (which define a rear exit opening 8); and right and left roof parts 14 and 114 (which define between themselves a free and longitudinally extending slot 12). The bottom of booth 5 is closed by an endless filter belt 20 which rotates along arrows 16 and 18, along the longitudinal direction of the booth.

An article transporting device 22 includes a transport chain 23 which is movable along the longitudinal slot 12 that is formed between roof parts 14 and 114 and is effective for suspending therefrom articles 24 that require spraying in booth 5. A powder spraying device 26 projects into the booth 5 through a side slot 28 formed in longitudinal wall 2 for spraying the articles 24 with a coating powder.

In right booth half 1*a*, front end wall 6 and rear end wall 10 are each individually connected to right longitudinal wall 2 by hinges 30 and each normal-ly extends at a right angle thereto, in a direction toward the other longitudinal wall 102. But end walls 6 and 10 may be swung outwardly by 90°, to a position where the end walls 6 and 10 lie in the plane of the inner surface of longitudinal wall 2. The hinges 30 are positioned such as to assure that end walls 6 and 10 closely adjoin the inner surface of longitudinal wall 2, in the manner depicted in FIG. 1 in relation to left longitudinal wall 102 whose end walls 106 and 110 are depicted in the flattened, i.e. straightened out position.

Each end wall 6, 106, 10 and 110 has a respective, swingably mounted, main wall element 31. The hinges 30 and 130 respectively connect the right and left main wall elements 31 to their respective longitudinal wall 2 and 102. Further, each end wall 6, 106, 10 and 110 includes a respective cutout 32 and a swingably mounted door 34 which swings about hinges 36 in the cutout 32.

When the hingedly mounted doors 34 are swung out of the plane of main element 31, the cutouts 32 define an entrance opening 4 in front end walls 6 and 106 and an exit opening 8 at the rear end walls 10 and 110. In the left-hand portion of FIG. 1 which depicts booth half 1*b*, the door 34 is shown in its closed position, that is flush with main element 31. At the right side of FIG. 1, however, door 34 is shown in its open position, that is at the position where it extends at an angle of 90° relative to its respective main element 31. Note that main wall element 31 and door 34 swing in different directions about their respective hinges relative to their longitudinal wall (2 or 102).

The roof parts 14 and 114 are respectively swingably fastened to longitudinal wall 2 (by hinges 40) and longitudinal wall 102 (by hinges 140). Roof parts 14 and 114 normally extend perpendicularly to longitudinal walls 2 and 102 to enclose the top of booth 5. However, each roof part may be swung upwardly, through an angle of 90° , such that the roofs lie flat in the plane of their respective longitudinal walls. In FIG. 1, roof part 114 is shown in the position where it is flush with, that is in the plane of, its longitudinal wall 102. Roof part 14 is depicted in the position where it extends perpendicularly to its longitudinal wall 2, as during a spraying operation.

At the front, each roof part 14 and 140 has a respective end flap 42 which is swingably fastened thereto by hinges 44 so that the flap 42 may be swung by an angle of at least 90° relative to its roof part. In the straightened out position, the end flaps 42 fill the front corner regions between the roof part 14 or 140 and the front of main element 31, thereby creating a flat rectangularly shaped surface that is more easily and effectively vacuumed 5. At the rear of booth 5, adjacent exit opening 8, the function of end flaps 42 is provided by the stationary, fixed roof elements 50 that are fastened to longitudinal walls 2 and 102 and lie in the plane of either longitudinal wall 2 or 102.

In operation, the roof and end wall portions of both walls 2 and 102 are either swung inwardly to form the booth 5 or are swung out (flattened) to form two spaced, continuous, and flat surfaces, as for example the flat surface that is depicted at the left-hand side of FIG. 1. In the flattened out position, the end flaps 34, the roof parts 14 and 114 and the fixed elements 50 are all aligned such that the corresponding inner surfaces 160, 162, and 164 lie in the plane of the inner surface 158 of their respective longitudinal wall 2 or 102. Moreover, these surfaces closely abut one another in a manner which leaves hardly any or no cracks between the elements which could interfere with the vacuuming of the composite surface by means of a suction nozzle 166. The suction nozzle 166 is disposed to traverse the flat surface and to vacuum away traces of remaining powder, practically through a single reciprocating movement over the flat surface, which as noted above is permeable to air.

As shown at the left-hand side of FIG. 1, suction nozzle 166 is usually parked in a starting position above roof part 114. Nozzle 166 is elongate and extends generally longitudinally relative to the coating apparatus 1. During a vacuuming cycle, nozzle 166 travels down and over all the inner surfaces 158, 154, 156, 160, 162, 152 and 164. The movement of suction nozzle 166 is controlled by transport pulleys 168 and 170 which are in turn driven by motor 172. Nozzle 166 moves all the way down to filter belt 20 and then up to its parked position. Note that reference numeral 174 denotes the entire vacuuming mechanism including the nozzle 166, its transport pulleys 168 and 170 and motor 172.

A similar vacuuming arrangement is provided at the right-hand side in FIG. 1 for longitudinal wall 2 where (for clarity) only a rear transport pulley 70 is depicted.

The wall and roof elements may be swung in and out to form either the flattened rectangular surface or the enclosure by a suitable drive such as drive 80 for roof element 14. Any type of drive 80 may be provided including those that are actuated and driven electrically, or pneumonically or hydraulically. Preferably, the drive 80 and suctioning apparatus 174 are under the control of an automatic control device (not shown) which controls the overall sequence of operating and cleaning the powder coating booth 5 automatically and in response to signals which indicate that a powder change is required.

Each of longitudinal walls 2 and 102, end walls 6, 106, 10 and 110, and roof parts 14 and 114 may be formed as a single piece or as a multi-part element. Typically, each element includes a frame 84 and an air permeable, porous cloth 86 which is stretched on the frame 84. It is also preferred that the frame 84 be formed by a bar having a U-shaped cross-section and that the frame be positioned such that the free leg ends 88 of the bar face toward the interior of booth 5 (when the wall and roof elements are flattened out as depicted at the left in FIG. 1). This bar orientation assures that air flow into suction nozzle 166 and into the corresponding device of wall 2 is never completely blocked since at least some air will be drawn through the hollow spaces 90 in the bars of frame 84.

The cloth 86 may be suspended from hooks 92 in the upper portion of frame 84 and tensioned by means of elastic elements 94 around the lower part of frame 84 to provide a smooth, fold-free, and easily vacuumed surface which rests snugly on frame 84. While, for clarity, cloth 86 has been drawn in FIG. 2 at a small distance from frame 84, in actuality, the cloth 86 is mounted directly against frame 84, as shown at the right side of FIG. 1.

During the vacuuming process, the slot 28 for the spraying nozzle 26 (at the right side longitudinal wall 2) is closed off by means of the velcro fastening arrangement 97, as seen in FIG. 3. One piece of velcro 97 is disposed on one side of the cloth 86 and a matching piece is fastened to the other side of the slot 28 so that the slot 28 is covered up during the vacuuming process. To keep the slot 28 normally open, a second velcro fastener 98 is provided in the opposed surface of cloth 86 and by means of this same velcro fastener 98 a portion of cloth 86 forming the slot can be folded onto itself as indicated by arrow 99.

Numerous modifications are possible without departing with the scope and spirit of the present invention. For example, the stationary roof element 50 may be made movable similar to end flap 42 of roof parts 14 and 114. Conversely, the end flaps 42 may be fixed in place. Or, end flaps 42 and roof element 50 may be connected to the end walls 10 and 110 instead of to roof parts 14 and 114. Still further, these parts may be hingedly connected to the longitudinal walls 2 and 102. The cloth 86 may be formed from other flexible materials or even from stiff materials which are capable of being vacuumed to remove traces of powder therefrom.

Another embodiment of the present invention is illustrated in FIGS. 4–8. This embodiment is quite similar to the embodiment of FIG. 1. The main differences (as seen in FIG. 4) lie in the omitting of the separate end flaps 42 of FIG. 1; in the orienting of the vacuuming mechanism such that it travels horizontally —not vertically as in FIG. 1; and in the manner in which the cloths are stretched over the frames and interconnected to one another.

For the sake of clarity, FIG. 4 depicts only the left side of powder coating apparatus 1 and shows a left longitudinal wall 202, a cover part 214 that is connected hingedly to longitudinal wall 202, a front end wall 206 and a rear end wall 210. Each end wall 206 or 210 has a main element 231 and a door 234 which can swing in and out of a cutout in the wall element 231. These elements swing and move exactly like the corresponding parts in the first embodiment.

As in the first embodiment, each of the elements 202, 231, 234 and 214 has a respective frame 302, 331, 334 and 314. The frames are swingably interconnected connected to one another and each supports a cloth on the side thereof which faces the interior of booth room 5. More specifically, cloth 402 extends over frames 302 and 314 and forms left longitudinal wall 202 and roof part 214. A second cloth 406 extends over wall element 231 and its door 234 to form front end wall 206. A third cloth 410 extends over the rear wall element 231 and its door 234 and forms rear end wall 210. Front and rear end walls 206 and 210 extend over the entire vertical extension of left longitudinal wall 202 and its roof part 214.

The cloth 402 (of longitudinal wall 202) is detachably connected by a slide fastener 506 to the cloth 406 of the front end wall 206 and is similarly connected to the cloth 410 which is disposed at the rear end wall 210, the latter by means of slide fastener 510.

The door 234 swings in and out of the plane of wall element 231 at the horizontal cut in cloth 406 and 410. This cut may be closed by means of the slide fastener 534.

As in the first embodiment, the bottom of the booth 5 is constituted of a revolving endless filter belt 20. The longitudinal wall 202 and end walls 06 and 210 are slightly above and adjacent the left-hand longitudinal edge of filter belt 20. A mirror copy of the above elements is provided at the right side of filter belt 20. In the straightened-out configuration of the left and right wall and roof elements (FIG. 4) there are provided two (left and right) rectangular, flat, and continuous inner surfaces 600 facing the interior of booth 5. The left surface is designed to be vacuumed by a vertically extending and horizontally movable suction nozzle 266 that is capable of traversing the entire surface 600.

Suction nozzle 266 draws residues of colored powder and dirt from inner surface 600 as well as from the lower edge 602 and upper edge 604 of the frames of the individual cloth elements. More specifically, suction nozzle 266 is suspended from a rail 606 that allows it to travel horizontally to the left or to the right in FIG. 4 and over the cloths 402, 406 and 410. Suction nozzle 266 is movable by motor 608, via a pulley element 610. The starting position of suction nozzle 266 is located outside booth 5 at the location of arrow 216 in FIG. 4. As noted above, the right-hand longitudinal wall (not depicted in FIG. 4) has its own identical suction nozzle. Consequently, the present invention enables all of the inner surfaces of the booth room 5 to be vacuumed and cleaned simultaneously and in a manner which permits the vacuuming process to be completed in an exceedingly short time period.

Figure 6:
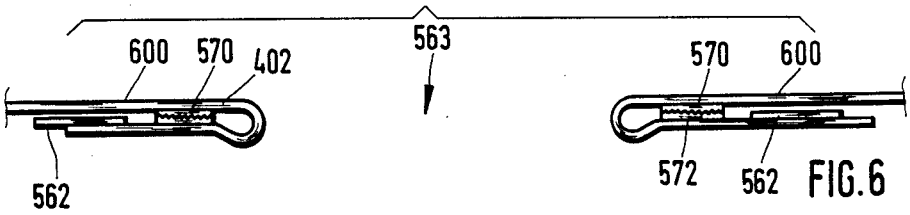
FIG. 6 is a partial cross-section along the plane defined by line VI—VI of FIG. 4.

Cloth 402 (of left longitudinal wall 202) contains two vertical slots 561 and 563 which are closable by respective slide fasteners 560 and 562. A powder spray device 226 may be introduced into booth 5 through these slots. For illustrative purposes, FIG. 4 shows slot 561 in its closed position and the slot 563 open. Details of the closed slot 561 and its slide fastener 560 appear in FIG. 5 which shows the slide fastener 560 on the outer side 7 of the cloth, facing away from the interior of booth room 5. The open slot 563 and its slide fastener 562 are shown in FIG. 6. Velcro closure elements 570 and 572 on each side of the slots permit the material of cloth 402 to be folded back and fastened in the open position.

Figure 7:
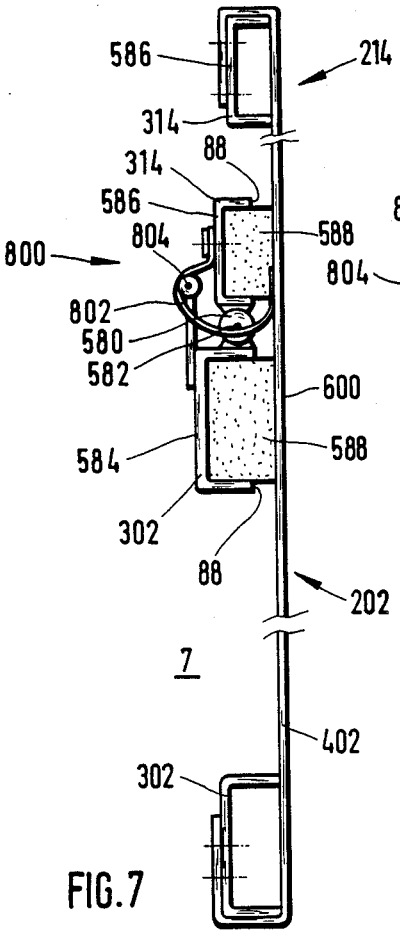
FIG. 7 is a cross-section along the plane defined by line VII-VII of FIG. 4 in a position where the walls of the booth are spread out for carrying out the cleaning process.
Figure 8:
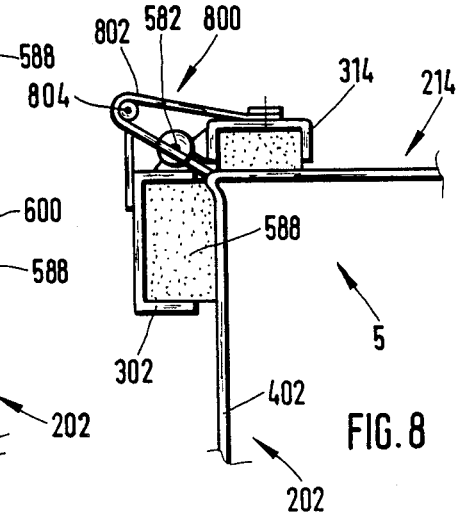
FIG. 8 depicts the embodiment of FIG. 7 in a position where the wall parts are swung inward to form the booth production cycles.

Frames for the wall and roof elements are shown in FIGS. 7 and 8, including the frame 302 of longitudinal wall 202 and frame 314 of roof element 214. The two frames are swingably connected to one another at a joint 580 that permits the roof element to swing about horizontal axis 582. The cross-section through frames 302 and 314 is U-shaped. The frame 302 includes the frame piece 584 and the frame 314 includes the frame element 586. The elements 584 and 586 are disposed adjacent one another, connected by joint 580, and filled with an elastically compressible foam material 588 that is porous to air and protrudes beyond the free end 88 thereof. The foam material 588 cushions the cloth 402 and is sufficiently soft to be slightly compressed by the tension from the cloth and to compensate, in this manner, for manufacturing tolerances and misalignments that may be present in the U-shaped structural elements.

In FIG. 8 the longitudinal wall 202 and the roof part 214 are inclined at an angle of 90° relative to one another. FIG. 7 depicts the relative position of the elements when the roof part 214 is swung out as during the vacuuming process. Note that since the swing axis 582 between the wall 202 and the roof part 214 is slightly offset to the outside of inner surface 600, the position depicted in FIG. 7 could cause wrinkling of the inner surfaces of the cloth 402. To remedy the problem and to keep cloth 402 taut and smooth during the vacuuming process, a tensioning device 800 is disposed at the hinge area. The tensioning device 800 includes a rubber band which pulls the cloth 402 toward the swing axis 582, as shown in FIG. 8.

One end of the band 802 is fastened on the frame 314 and the other end of the band 802 passes between the frame of roof 214 and the frame 302 of longitudinal wall 202 and is ultimately fastened to cloth 402. Rubber band 802 is guided by a roller 804 which is rotatably fastened to frame 302 and arranged eccentrically to swing axis 582.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A powder coating booth, comprising:

a plurality of wall elements which are inclined to one another in accordance with a first configuration to define at least a portion of a powder spraying booth, the wall elements having interior surfaces which are exposed to powder within the booth and which require occasional removal of residues of powder settling on the interior surfaces, the interior surfaces including interior surfaces which extend in generally vertical planes and at least one interior surface which extends in a generally horizontal plane;

flattening means for enabling at least several of the wall elements to be straightened out in accordance with a second configuration at which all of the interior surfaces of the booth lie in vertical planes; and vacuuming means for traversing the interior surfaces of the booth and for vacuuming the powder residues therefrom, while the wall elements are in their second configuration.

2. The powder coating booth of claim 1, wherein the booth is constructed such that in the second configuration the wall elements of the booth are transformed into at least two longitudinally and vertically extending flat and continuous walls which lie parallel to and are spaced from one another.

3. The powder coating booth according to claim 2, corresponding two of said flat and continuous walls, the vacuuming means including a respective vacuuming element for each of the flat and continuous walls.

4. The powder coating booth according to claim 3, further including hinges, the wall elements in each of the two flat walls being hingedly connected to one another by the hinges.

5. The powder coating booth according to claim 4, wherein each flat wall is substantially rectangular.

6. A method for removing residues of powder from the interior surface of a powder coating booth, the method providing the steps of:

providing a powder coating booth having a plurality of wall elements including at least two spaced, parallel, and longitudinally extending walls and at least one roof element, the longitudinal walls and roof element having a first configuration which defines a booth, the wall elements having interior surfaces which are inclined to one another when the wall elements are in the first configuration;

manipulating the wall elements into a second configuration wherein the wall elements are swung out such as to yield two flat longitudinal walls; and passing a vacuum mechanism over the interior surface associated with the two flat longitudinal walls and vacuuming the residues of powder therefrom.

7. A powder coating booth, comprising:

a plurality of wall elements including at least two spaced, parallel, and longitudinally extending walls and at least one roof element, the longitudinal walls and the roof element having a first configuration which defines a booth, the wall elements having interior surfaces which are inclined to one another when the wall elements are in the first configuration; and the wall elements having a second configuration wherein several of the wall elements are swung away from their position in the first configuration and in the second configuration all of the interior surfaces extending parallel to one another.

8. The powder coating booth according to claim 7, wherein the wall elements are constructed of a material which is permeable to air and wherein, in the second configuration, the interior surfaces lie in two parallel planes, the interior surface in each plane being substantially continuous.

9. The powder coating booth according to claim 8, further including at least one suction nozzle and means for guiding the at least one suction nozzle over the interior surfaces to vacuum residues of powder material therefrom.

10. The powder coating booth according to claim 9, further including a setting drive for automatically moving the wall elements of the booth into the second configuration.

11. The powder coating booth according to claim 10, wherein the setting drive operates electrically.

12. The powder coating booth according to claim 10, wherein the setting drive operates pneumatically.

13. The powder coating booth according to claim 10, wherein the setting drive operates hydraulically.

14. The powder coating booth according to claim 9, wherein each continuous surface is rectangular and has a width and a length dimension, the suction nozzle being elongate and having a length which extends over one of the dimensions of the continuous surface and the suction nozzle being movable transverse to its length.

15. The powder coating booth according to claim 14, wherein at least several of the wall elements require swinging by about 90° to change then from the first to the second configuration and vice versa.

16. The powder coating booth according to claim 7, wherein the wall elements include end wall elements disposed to a front and to a rear side of the booth.

17. The powder coating booth according to claim 16, in which each end wall comprises a main wall element which is swingably connected to another one of the wall elements of the booth and a door which swings relative to the main element.

18. The powder coating booth according to claim 16, wherein the roof element is comprised of at least two roof parts and wherein one roof part is swingably connected to one of the longitudinal walls and the other is swingably connected to the other longitudinal wall.

19. The powder coating booth according to claim 9, wherein each continuous surface is rectangularly shaped.

20. The powder coating booth according to claim 7, wherein the wall elements are comprised of a material which is permeable to air.

21. The powder coating booth according to claim 7, each wall element comprising a frame and a cloth mounted on the frame.

22. The powder coating booth according to claim 21, wherein each frame is comprised of a profiled bar having a U-shaped transverse cross-section.

23. The powder coating booth according to claim 22, wherein the bar has free ends, the free ends of the bar being directed toward the interior of the booth, in the second configuration.

24. The powder coating booth according to claim 23, further comprising elastically compressible cushions disposed in the bar.

25. The powder coating booth according to claim 21, wherein at least two cloths associated with adjacent wall elements are detachably connected to one another by a closure element.

26. The powder coating booth according to claim 25, wherein the closure element is a slide fastener.

27. The powder coating booth according to claim 7, further comprising a slot in at least one of the wall elements, for a powder spraying device to protrude therethrough.

28. The powder coating booth according to claim 27, wherein the slot has slot edges and the slot edges are detachably connectable to each other.

29. The powder coating booth according to claim 28, further comprising a slide fastener for connecting the edges to one another.

30. The powder coating booth according to claim 21, further comprising a tensioning device for tensioning the cloth on the bar.

31. The powder coating booth according to claim 21, further comprising tensioning means for smoothing the cloth.

32. The powder coating booth according to claim 7, further comprising a movable belt disposed below the booth.

33. The powder coating booth according to claim 9, further comprising means for moving the suction nozzle relative to the wall elements.

34. The powder coating booth according to claim 7, further comprising a separation slot in the at least one roof element and an article suspending device for passing through the separation slot and for supporting at least one article to be sprayed thereon.

* * * * *